US005657744A

United States Patent [19]

Vianen

[11] Patent Number: 5,657,744

[45] Date of Patent: Aug. 19, 1997

[54] VENTILATION CEILING WITH INTEGRAL AIR FILTER UNITS

[76] Inventor: Hendrikus Joseph Vianen, Van der Valkboumanlaan 84, NL-3446 GK Woerden, Netherlands

[21] Appl. No.: 528,986

[22] Filed: Sep. 15, 1995

[51] Int. Cl.[6] ..... B08B 15/00

[52] U.S. Cl. ..... 126/299 E; 55/242; 55/440; 55/444

[58] Field of Search ..... 55/242, 229, 440, 55/444; 126/299 R, 299 D, 299 E; 454/49, 339, 341, 343, 345

[56] References Cited

U.S. PATENT DOCUMENTS 3,628,311 12/1971 Costarella et al. ..... 126/299 E X
3,984,505 10/1976 Gutermuth et al. ..... 454/49 X
4,101,299 7/1978 Bertucci ..... 126/299 E X
4,354,863 10/1982 Oleszak ..... 126/299 D X

*Primary Examiner*—Harold Joyce
*Attorney, Agent, or Firm*—Young & Thompson

[57] ABSTRACT

Ventilation ceiling, comprising channel elements running at a distance from and parallel to each other, and ceiling panel elements leading with their side edges into the channel elements, which chapel elements are in fluid communication with a fluid-collecting element, while the panel elements serve the purpose of extracting grease and/or livid constituents from the air, and the channel elements serve the purpose of conveying the extracted grease and liquids to the fluid-collecting element, and a fixed supply line for cleaning agents provided and serves the purpose of dispensing cleaning agent into the channels at intervals.

6 Claims, 2 Drawing Sheets

VENTILATION CEILING WITH INTEGRAL AIR FILTER UNITS

FIELD OF THE INVENTION

The invention relates to a ventilation ceiling, of the type known from, for example, DE-A-2718611.

BACKGROUND OF THE INVENTION

Such a ventilation ceiling can be found in, for example, the kitchen of a hospital or retirement home. The ceiling contains air supply and air discharge elements, and possibly also light fittings. The air discharge elements increasingly serve the purpose of removing grease etc. from the extracted air, so that they act as air filter elements. For example, to that end the air discharge elements are designed as double-walled coffers which have supply and discharge openings in the walls and grease extractors disposed in said coffers.

Making those air filter elements curved ensures that the constituents filtered out of the air will flow to the side edges of the filter element, where the constituents can be collected, for example, in a collecting element.

DE-A-2949235 discloses, for example, double-curved coffers which are square in top view. Channel parts are detachably disposed below the edges thereof. The idea is to remove those channel parts regularly, in order to clean them. The coffers themselves can be cleaned by removing them from the ceiling and placing them in a dishwasher. Removing the channel parts regularly is troublesome, and is therefore often left undone. In practice, the channel parts are cleaned only when they are full to the brim, and grease and the like is dripping out of them.

In order to make extracting the grease and the like more reliable, an attempt was made to connect the channel parts to a grease-collecting vessel, such as a tank placed on the ground, or the sewerage system. The idea was that the grease end other constituents filtered out of the channel parts would flow out of the channel parts by themselves into the grease-collecting vessel. However, it was found that this did not work in practice: the grease hardly flows any further along in the channel parts. Consequently, there is hardly any grease discharge to the grease-collecting vessel, and the channel parts have become clogged after some time, which leads to leaking again from the channel parts.

The desire to simplify the cleaning of a ventilation ceiling with integral air filter elements and to make such cleaning more reliable has therefore been felt for a long time.

In order to clean the channel parts, a system was proposed in which it is not necessary to remove the channel parts. This system comprises a mobile stock tank with aqueous cleaning agent, a pump and a flexible hose. The idea is to place the outlet of the hose in a channel part by hand, following which aqueous cleaning agent is pumped into the channel part through the hose. It is expected that the cleaning agent will loosen and dissolve the grease and the other constituents in the channel and will take them to the grease-collecting vessel.

Personnel frequently forget to use this known system, with the result that the channel parts become clogged, and can then be cleaned only by mechanical means, so that they still have to be removed. Moreover, only one channel part can be treated at a time. It is necessary to check in each case whether all channel parts have been treated with the system, and the operative himself has to keep an eye on the duration of the flushing. The quality of the flushing is consequently not consistent. In addition, flushing for too long (for example, by forgetting that flushing is going on) is wasteful. Connecting up the system in each case is labour-intensive. Moreover, standing on the ground and inserting the nozzle by hand into the channel parts several meters higher up is difficult and can lead to errors. There is consequently a great risk of the channel parts overflowing. Besides, the system is expensive, since it must have its own pump; and the channel parts and the discharge channel disposed downstream thereof and leading to the grease-collecting vessel are often not designed for flushing with the cleaning agent, so that there is a risk of leakage.

SUMMARY OF THE INVENTION

The object of the invention is to make a further improvement in the solution to the problem of cleaning ventilation ceilings.

To this end, it is proposed that a fixed supply line for cleaning agent should be provided, in order to introduce the cleaning agent directly into the channel elements, and the supply line is adapted so that it can dispense cleaning agent at intervals.

This means that the cleaning can be put into operation or ended by one action in each case, for example by opening and closing a shut-off valve element in the supply line. Such action takes relatively little effort, with the result that there is less chance that it will be forgotten. Putting the supply line into operation is preferably regulated automatically, for example by a time switch.

A manifold element is preferably incorporated in the supply line, in order to connect the supply line to each channel element.

It is preferable for the channel elements to open out into a common trough, in order to discharge cleaning agent and substances removed from the channel elements to a grease-collecting vessel. In order to ensure a good throughflow of cleaning agent, without the risk of overflowing, the trough is amply dimensioned for processing a volume per unit time which is at least equal to the sum of the volumes to be processed by every channel element in that unit of time.

The channel elements and/or the trough element may be clad with a friction-reducing and/or adhesion-reducing material, such as teflon.

In practice, it is advantageous to use heated cleaning agent, for example at a temperature of approximately 70° C. This can be flushed through the channel elements every 24 hours for, say, 5 minutes. Depending on the loading of the ventilation system, which depends on, for example, the type of kitchen and the type of equipment present in the kitchen, it is possible to flush more frequently and for a longer period in each case, or indeed less frequently and for a shorter period. The person skilled in the art will easily establish an optimum for the frequency and duration of the flushing by carrying out simple experiments.

It has already been known for a long time in connection with a cooker extractor hood to spray the entire surface of the steeply sloping, flat grease filter with powerful jets of a cleaning agent from a cleaning unit permanently fixed in the extractor hood. In this known situation there is not the problem of a large, essentially horizontal surface, such as that in the case of a ventilation ceiling.

BACKGROUND OF THE INVENTION

The invention is explained in greater detail below on the basis of a non-limiting exemplary embodiment, with reference to the appended drawings, in which.

DETAILED DESCRIPTION OF THE INVENTION

Figure 1:
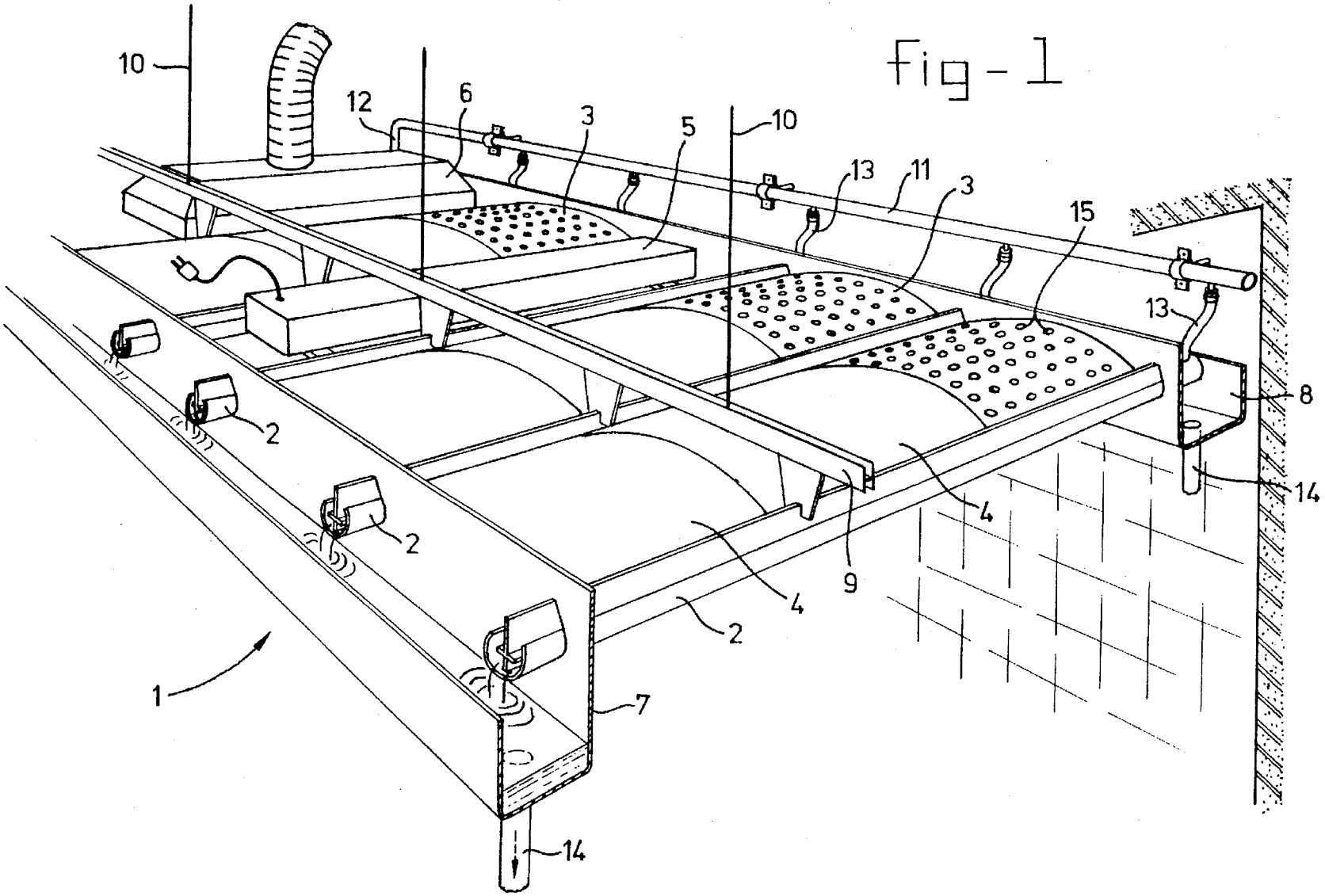
FIG. 1 shows a view in perspective of a ventilation ceiling designed according to the invention.
Figure 3:
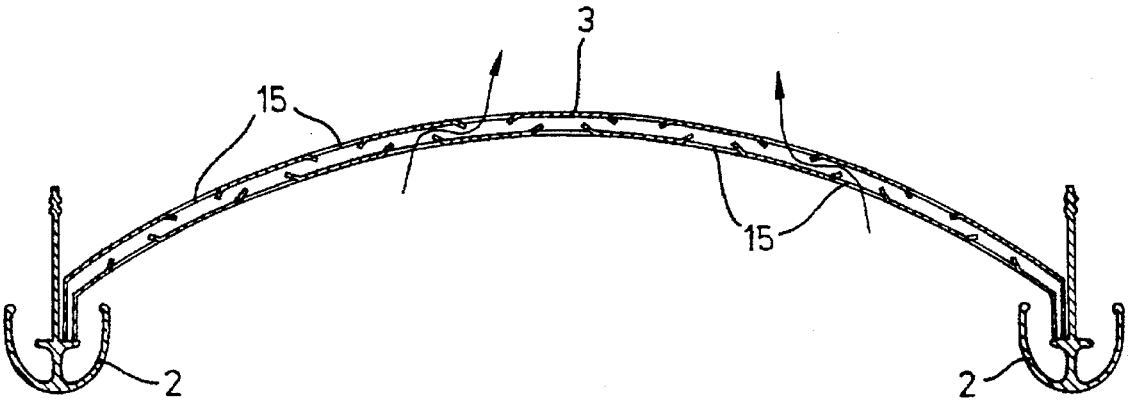
FIG. 3 shows a view in section of a part of the ventilation ceiling shown in FIG. 1, in which a ceiling panel is shown with its side edges resting on a channel element in each case.
Figure 2:
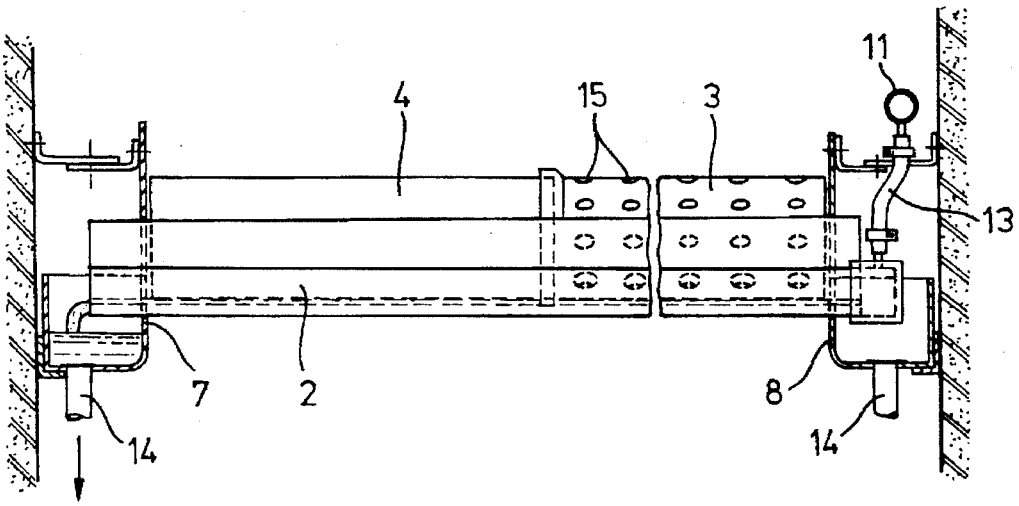
FIG. 2 shows a side view of the ventilation ceiling shown in FIG. 1.

A ventilation ceiling 1 is shown in the drawing, in particular in FIG. 1. The ceiling is essentially composed of channel elements 2 running virtually horizontally at a distance from and parallel to each other, which elements are bridged by cylinder-segment-shaped panel elements 3, 4. The channel elements are, for example, three meters or more in length. As shown in greater detail in FIG. 3, each panel element 3, 4 rests with its side edges on a respective channel element 2. The panel elements 3 are double-walled, as shown in FIG. 3, and are perforated. Air is extracted from the space below the ventilation ceiling through these panel elements 3. The perforations 15 in one wall of the panel elements 3 are staggered relative to those in the other wall. The air consequently does not move in a straight line through the panel elements 3 (see the arrows in FIG. 3), with the result that grease and other substances are filtered out of the air. These substances are collected inside the panel elements 3. As a result of the slope of the panel elements 3 in the direction of the channel elements 2, grease and the like will flow out of the panel elements 3 into the channel elements 2 and will collect there.

The panel elements 4 are single-walled and unperforated. They do not contribute to the ventilation.

Between the ends, the channel elements are connected to a horizontal beam 9, which runs parallel to the trough-shaped elements 7, 8 and which is suspended from wires 10.

A light fitting 5 and an air supply element 6 are also accommodated in the ventilation ceiling 1. Both likewise rest with their side edges on respective channel elements 2.

The arrangement of the panel elements 3, 4 and the fittings 5 and the air supply elements 6 can be adapted to requirements in each case, and is determined by, for example, the positioning of cockers etc.

The ends of the channel elements 2 lead into virtually horizontal, trough-shaped elements 7, 8, and rest on a side wall thereof. These trough-shaped elements 7, 8 are positioned essentially at right angles to the lengthwise direction of the channel elements 2. The channel elements 2 slope down slightly in the direction of the trough 7. The troughs 7 and 8 each have a discharge pipe 14, which is connected to the conventional sewerage system. The troughs 7 and 8 slope down slightly in the direction of the respective discharge pipe 14. At the side of the trough-shaped element 8 each channel element 2 is connected to a respective outlet 13 of a manifold 11 of a fixed pipe 12 for the supply of a cleaning agent. The pipe 12 accommodates a shut-off valve (not shown), which can be opened with a timer-operated solenoid (not visible). The pipe 12 is connected to the conventional water mains, and runs through a heating element (not shown). A distribution unit (not shown), which is generally commercially available, is also connected to the pipe 12, for mixing a cleaning agent into the tap water. The connection of the pipe 12 to the heating element and the distribution unit, the controllable shut-off valve and the time-switch control therefor will be clear to the person skilled in the art without further explanation. A control panel for programming the flushing can be set up in an easily accessible position in the kitchen.

The way in which the ventilation ceiling works is as follows then: During the use of the kitchen, grease etc. is filtered out by .the panel elements 3, and flows into the channel elements 2. The grease and the like will only flow out of the channel elements 2 into the trough 7 by itself to a limited extent. Once every 24 hours the timer element activates the solenoid, in order to keep the shut-off valve in the pipe 12 open for five minutes. Water with cleaning agent at a temperature of approx. 70° C. flows out of the outlets 13 into the channel elements 2. The liquid coming out of the outlets 13 flows gently through the channel elements 2 and is then collected in the trough 7, and is subsequently discharged to the sewer through the pipe 14. Due to the fact that the liquid flows gently through the channel elements 2, the cleaning agent has sufficient time to loosen and/or dissolve the greases etc., following which they are entrained with the flow. There is therefore no need for a mechanical action of the liquid, as would be the case with powerful liquid jets. Nor is there any risk of overflowing over the channel elements 2, which are open at the top side. It is sufficient if during the flushing the channel elements are filled no more than halfway up with liquid. The trough 7 is amply dimensioned to collect such a quantity of liquid from all channel elements 2 opening out into it and to discharge such liquid into the sewer. Should a leakage occur in the manifold part 11, the trough 8 will serve as a drip tray, and will consequently prevent flooding.

Of course, other embodiments also fall within the scope of the invention. The troughs 7, 8 can be connected to, for example, a water purification system, instead of a sewer.

I claim:

1. Ventilation ceiling comprising:

a plurality of ceiling panel elements for extracting grease and liquid constituents from air;

a plurality of channel elements running at a distance from and parallel to each other for conveying extracted grease and liquid constituents to a fluid-collecting element, said ceiling panel elements leading with their side edges into said channel elements, and the width of each channel element being substantially smaller than the distance between the side edges of each ceiling panel element, said channel elements being in fluid communication with said fluid collecting element; and a cleaning agent supply line fluidly connected to a manifold having an outlet located adjacent an end part of each channel element opposite the fluid collecting element for intermittently dispensing cleaning agent into the channel elements.

2. Ventilation ceiling according to claim 1, wherein the supply line includes a shut-off element connected to a timer element for opening and closing said shut-off element at predetermined times.

3. Ventilation ceiling according to claim 2, wherein the timer element is set to keep the shut-off element open at least once a month for no more than one hour.

4. Ventilation ceiling according to claim 2, wherein the timer element is set to keep the shut-off element open at least once a day for no more than 10 minutes.

5. Ventilation ceiling according to claim 1, wherein the channel elements open out into a common trough element which in turns opens out into the fluid collecting element.

6. Ventilation ceiling according to claim 5, wherein the throughflow surface area of the trough element is at least equal to the sum of the throughflow surface areas of every channel element opening out into the trough elements.

* * * * *